US007278871B2

(12) United States Patent
Maschler

(10) Patent No.: US 7,278,871 B2
(45) Date of Patent: Oct. 9, 2007

(54) AXIAL THRUST BULB SOCKET WITH BAYONET REMOVAL

(75) Inventor: Kristofer J. Maschler, Blue Springs, MO (US)

(73) Assignee: Peterson Manufacturing Co., Grandview, MO (US)

( * ) Notice: Subject to any disclaimer, the term of this patent is extended or adjusted under 35 U.S.C. 154(b) by 0 days.

(21) Appl. No.: 11/372,604

(22) Filed: Mar. 10, 2006

(65) Prior Publication Data

US 2007/0212921 A1 Sep. 13, 2007

(51) Int. Cl.
*H01R 4/50* (2006.01)

(52) U.S. Cl. ..... 439/336; 439/375; 439/616; 439/672

(58) Field of Classification Search ..... 439/336, 439/616, 672, 375, 611, 613
See application file for complete search history.

(56) References Cited

U.S. PATENT DOCUMENTS

| | | | | |
|---|---|---|---|---|
| 1,616,654 A | | 2/1927 | Gammeter | |
| 1,760,693 A | | 5/1930 | Gustin | |
| 3,344,388 A | | 9/1967 | Parker et al. | |
| 3,775,731 A | * | 11/1973 | Merki et al. | 439/556 |
| 4,227,760 A | * | 10/1980 | Witek, Jr. | 439/101 |
| 4,423,915 A | * | 1/1984 | Brownlee | 439/218 |
| 4,572,601 A | * | 2/1986 | Jones et al. | 439/180 |
| 4,809,143 A | | 2/1989 | Feger et al. | |
| 5,087,213 A | * | 2/1992 | Drapcho et al. | 439/672 |
| 5,411,410 A | | 5/1995 | Ogawa et al. | |
| 5,536,175 A | | 7/1996 | Forish | |
| 5,580,159 A | | 12/1996 | Liu | |
| 5,895,283 A | | 4/1999 | Takanashi | |
| 6,017,235 A | | 1/2000 | Sawada et al. | |
| 6,075,318 A | | 6/2000 | Noll et al. | |

* cited by examiner

*Primary Examiner*—Hien Vu
*Assistant Examiner*—X. Chung-Trans
(74) *Attorney, Agent, or Firm*—Malcolm A. Litman; Dennis A. Crawford; Shughart Thomson & Kilroy PC

(57) ABSTRACT

An axial thrust bulb socket with bayonet removal of the bulb includes a flat bulb support member mounted in spaced relation to a pair of resilient socket end connectors and having a circular socket opening with a pair of pin retainer tabs extending therefrom toward the socket end connectors and having pin latch notches at ends thereof which open toward the socket end connectors. Pin clearance notches are formed at edges of the socket opening in alignment with guide edges of the tabs. The tabs have pin guide grooves which align with the pin latch notches. A bayonet style bulb can be inserted in the bulb support member by aligning the bayonet pins thereof with the pin notches of the tabs and then inserting the bulb base into the socket opening by axial movement alone until the pins snap into the latch notches. The bulb can be removed in a conventional bayonet manner and can, alternatively, be installed in a bayonet manner for manual replacement.

17 Claims, 3 Drawing Sheets

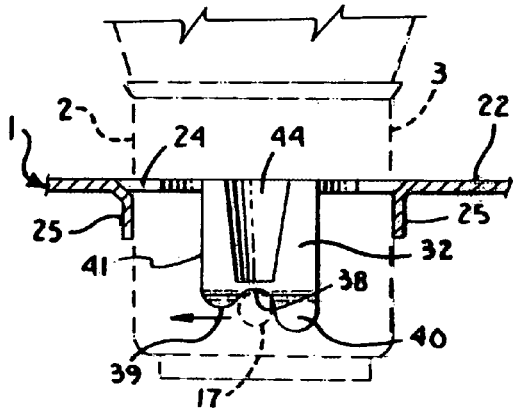
Fig. 8.
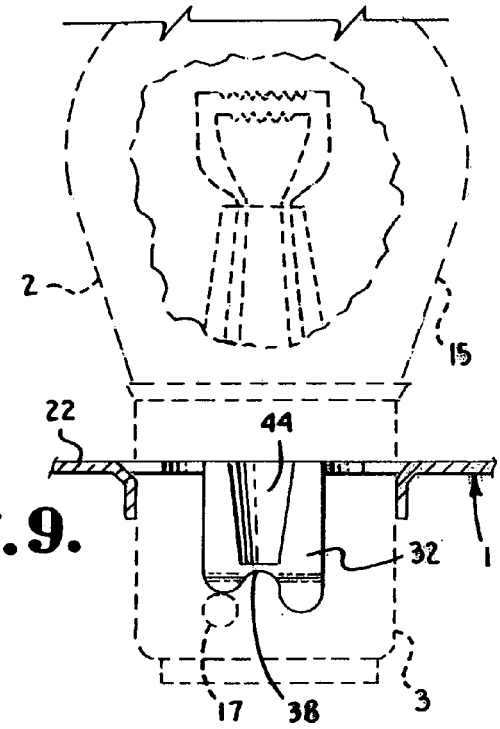
Fig. 9.
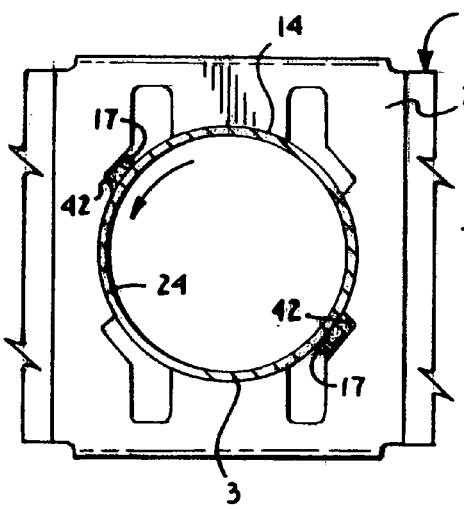
Fig. 10.
Fig. 11.
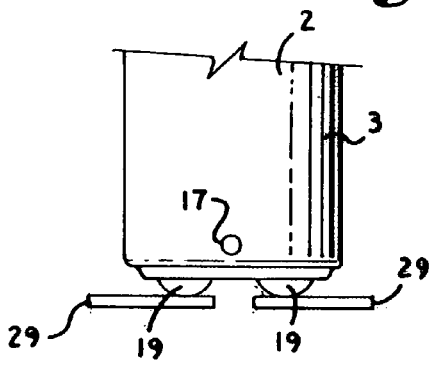

AXIAL THRUST BULB SOCKET WITH BAYONET REMOVAL

BACKGROUND OF THE INVENTION

The present invention relates to light bulb sockets and, more particularly, to such a socket which is configured to enable either axial insertion of a bayonet base bulb (straight push), or bayonet insertion thereof (push and twist), along with bayonet removal of the bulb (push, twist, pull).

Many types of automotive lamps employ bayonet based bulbs, such as for tail lights, brake lights, turn signal lights, back-up lights, running lights, and the like. Bayonet type bulbs and sockets are preferred in many automotive applications because positive engagement of electrical contacts can be maintained despite vibrations and jolts experienced by the vehicle frame, as well as temperature variations of the socket components. Additionally, bayonet type bulbs are quick and easy to insert and remove. In contrast, contacts associated with other types of bulb bases can be loosened by such environments. In a typical bayonet arrangement, a bulb has a cylindrical brass barrel or base with at least one and, in automotive applications, usually two projections or pins extending radially therefrom. The base forms one electrical contact, usually the negative contact. An inner end of the base (as installed within a socket) has an electrical contact which is insulated from the base and which is usually designated the positive contact. The base covers a sealed end of an evacuated glass envelope which is otherwise generally spherical and which has a filament mounted therein. The filament is connected between the base and the end contact. A bayonet type socket is typically formed by a sheet metal cylinder with J-shaped slots to receive the pins and an end contact which is resiliently urged in an outward direction. The bulb is inserted axially into the socket until the end contact of the base engages the end contact of the socket and rotated through a small angle to position the base pins in the hooked ends of the J-slots. Removal of a bayonet bulb requires pressing the bulb axially inward against the spring of the end contact, turning through a small angle to release the base pins from the hooked ends of the J-slots, then axial removal of the bulb from the socket. Some types of bayonet style bulbs have a pair of filaments and a corresponding pair of end contacts.

It is generally advantageous, in terms of productivity, to mechanize assembly of manufactured products, as long as the number of manufactured units justify setup costs. While the steps required to insert a bayonet bulb into a bayonet style socket are relatively quick and easy to perform by a human, they are relatively complex to accomplish by mechanical processes. Such a process requires a mechanism to grasp a bulb from a bulb source or carrier, position the bulb in alignment with the socket so that the latch pins of the bulb align with slots in the bayonet socket, insert the bulb base into the socket against the resilient end contact, rotate the bulb to engage the latch pins with the hooked ends of the J-shaped slots, release the bulb, then repeat the process for the next socket to receive a bulb, all without breaking the bulb.

Therefore, there is a need for an improved socket for bayonet style bulbs which simplifies mechanical insertion of bayonet bulbs into such sockets and which enables replacement of the bulb, preferably in a conventional bayonet manner.

SUMMARY OF THE INVENTION

The present invention provides an improved bayonet socket which enables axial insertion of a bayonet bulb base thereinto or, alternatively, conventional bayonet insertion of the bulb, along with bayonet removal of the bulb from the socket.

The socket structure of the present invention includes a bulb support member having a circular or cylindrical opening to receive the cylindrical bulb base with clearance notches formed at the opening to clear the radial pins of the bulb base. In a preferred embodiment of the socket, the opening is formed in a sheet metal bulb support member which forms one electrical contact for the bulb, such as a negative or common contact for the bulb. A resilient end contact is positioned in spaced relation to the opening of the socket and is arranged to resiliently urge the bulb axially outward from the socket. Alternatively, a pair of resilient end contacts can be provided for bulbs with two filaments. A pair of resilient pin retainer tabs are positioned at the circular opening and in mutually diametric opposition thereacross. The tabs extend inward within the socket toward the end contact. The tabs may be formed from the same sheet metal through which the socket opening is formed. Free ends of the tabs are provided with pin latch notches to receive the pins of the bulb base. The pins on opposite sides of the bayonet bulb base are offset axially, and the tabs have respective lengths to accommodate the locations of the pins. At least one edge of each tab is aligned with one of the clearance notches and forms a pin guide edge of the tab. The clearance notches, the pin guide edges, and the latch notches form the equivalent of the J-shaped slots of some conventional bayonet sockets. The tabs preferably include pin guide grooves which are aligned with the latch notches and which facilitate alignment of the pins of the bulb base with the latch notches.

A bayonet bulb can be inserted entirely axially with the pins aligned with the latch notches such that the pins engage the resilient tabs, pushing them radially outward until the pins snap into the latch notches. Since the pins are at different axial positions or axially offset, the bulb must be oriented so that the lower pin aligns with the longer tab and an upper pin aligns with the shorter tab. Alternatively, the bulb can be inserted into the socket of the present invention in the conventional bayonet manner; that is, the bulb can be inserted axially with the pins aligned with the clearance notches, until the end contact is engaged, and then rotated in a "forward" insertion direction to engage the pins with the latch notches. In either case, the bulb is removed in the conventional bayonet manner by pushing the bulb in slightly against the resilience of the socket end contact and rotating in a "reverse" or removal direction to disengage the pins from the latch notches, then withdrawing the bulb axially with the pins engaging the pin guide edges to align with the clearance notches.

While the socket has been described with a sheet metal component having a socket opening formed therein, it is foreseen that the socket could also be formed as a tubular component of an insulating material, such as a plastic or ceramic, with the resilient tabs and resilient contact or contacts mounted therein. Additionally, the socket of the present invention can be incorporated into a lamp fixture or housing for mounting on a vehicle or the like. The configuration of the socket of the present invention allows a relatively simple mechanical process to be devised for inserting a bayonet bulb axially into such a fixture or housing during assembly thereof with manual replacement of the bulb in a conventional bayonet manner.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIGS. 8 and 9 are views similar to FIG. 6 with a bulb shown in phantom and illustrating the relationship of a latch pin of a bayonet bulb with a latch notch of a pin retainer tab of the axial thrust socket of the present invention.

FIG. 10 is a greatly enlarged fragmentary top plan view of a bayonet bulb base positioned in a socket opening of the bulb support member and shows the bayonet pins aligned with clearance notches of the socket opening.

FIG. 11 is an enlarged fragmentary side elevational view taken on line 11-11 of FIG. 1 and illustrates engagement of a pair of bulb end contacts with a corresponding pair of socket end contacts.

DETAILED DESCRIPTION OF THE INVENTION

Figure 1:
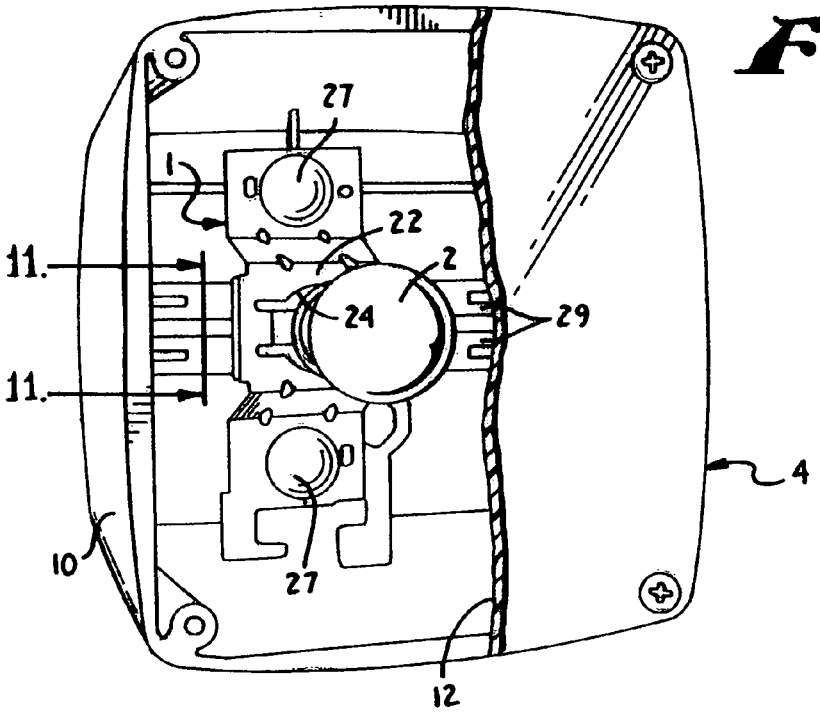
FIG. 1 is a perspective view of a lamp unit incorporating an axial thrust bayonet socket which embodies the present invention, with a portion of a lens of the unit broken away to illustrate internal details.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawings in more detail, the reference numeral 1 generally designates an axial thrust bayonet socket structure with bayonet removal of the bulb which embodies the present invention. The axial thrust socket structure 1 is adapted to enable insertion of a bulb 2 having a conventional bayonet style bulb base 3 by an entirely axial thrust, while enabling removal of the bulb 2 from the bulb support member 1 in a conventional bayonet manner. The socket structure 1 also preferably enables insertion of the bulb 2 in a conventional bayonet manner. The capability of insertion of the bulb 2 into the socket structure 1 in a motion requiring only an axial thrust facilitates the mechanical assembly of a lamp unit 4 incorporating the socket 1, as shown diagrammatically by the bulb insertion member 5 in FIG. 2.

Figure 2:
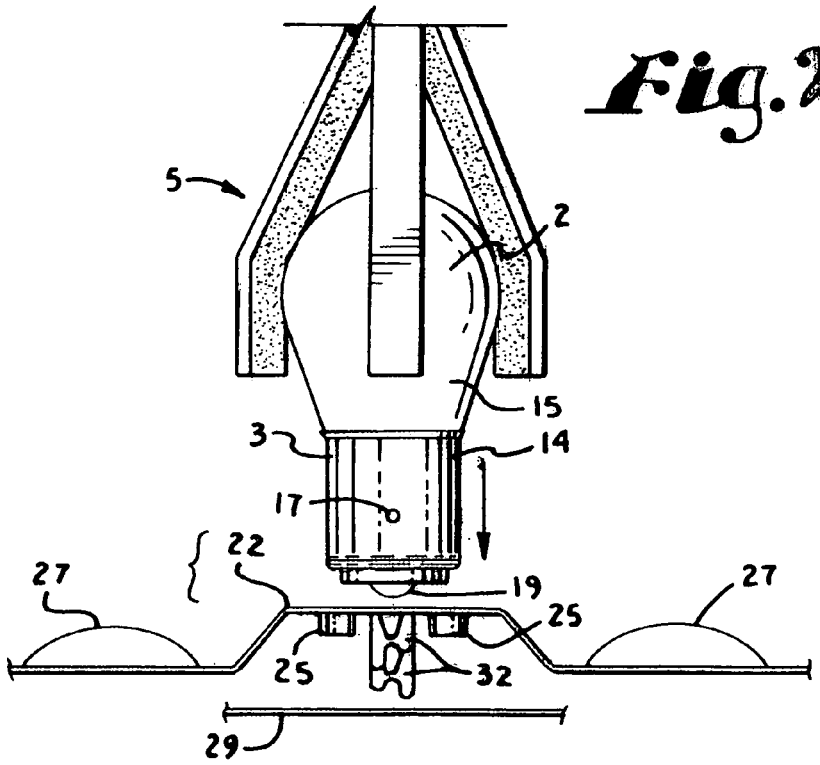
FIG. 2 is an enlarged fragmentary side elevational view illustrating a bayonet bulb being inserted axially into a socket according to the present invention by a simple mechanical process.

Referring to FIGS. 1 and 2, the lamp unit 4 generally includes a housing 10 in which the components of the socket structure 1 are mounted. The lamp unit 4 may, for example, be a vehicle lamp unit, such as a tail light, turn signal light, parking light, running light, or the like. The lamp unit 4 preferably includes a lens 12 which can be clear or can be tinted red, yellow or amber, blue, green, or the like. The lamp unit 4 includes electrical connectors, such as a plug socket (not shown), for making electrical connections to the bulb 2 by way of the bulb socket 1 and mounting structure (not shown) for mounting the lamp unit 4 on a vehicle.

Figure 3:
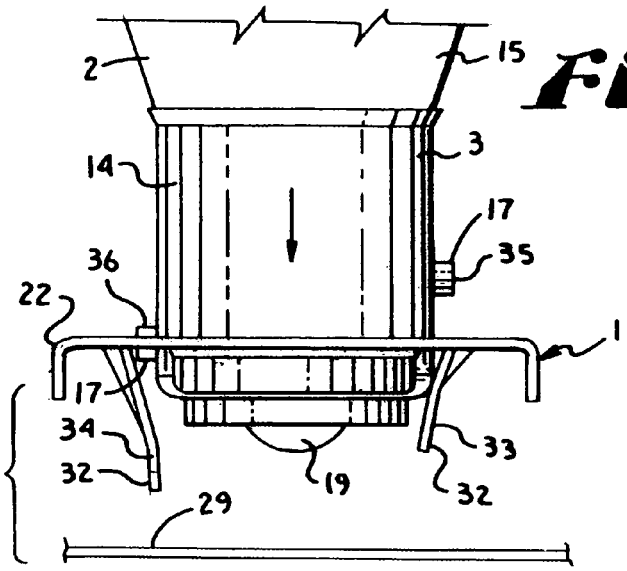
FIGS. 3, 4, and 5 are greatly enlarged fragmentary side elevational views illustrating progressive stages of a bayonet bulb being inserted axially into a socket according to the present invention.
Figure 4:
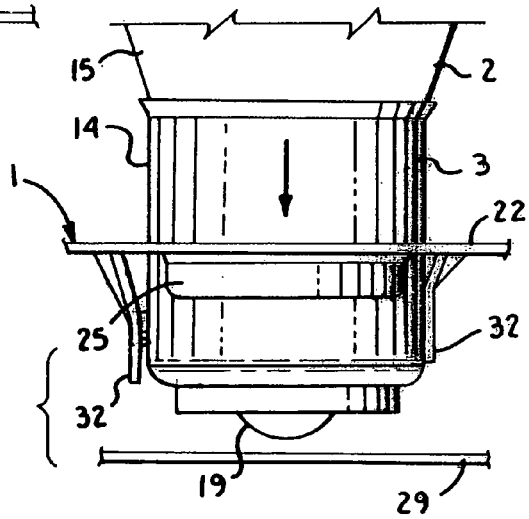
Figure 5:
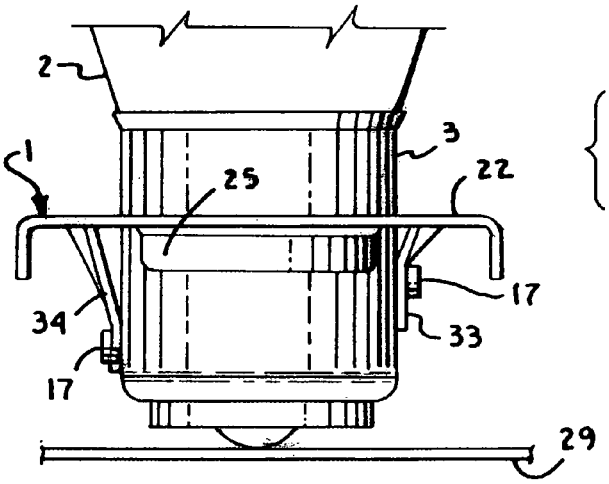
Figure 6:
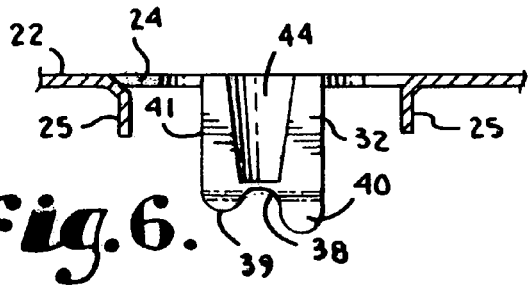
FIG. 6 is a greatly enlarged fragmentary cross sectional view of a bulb support member of the socket and illustrates one of a pair of pin retainer tabs of the socket of the present invention.
Figure 7:
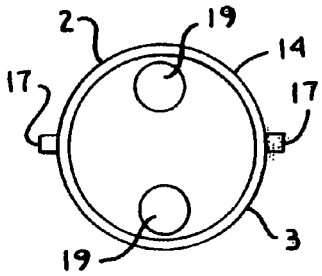
FIG. 7 is a greatly enlarged bottom plan view of a contact end of a bayonet base bulb.

The bulb 2 is a conventional bayonet bulb including a cylindrical, conductive metal barrel 14 forming the bulb base 3 and enclosing a sealed end of an evacuated glass envelope 15 in which one or sometimes two filaments are mounted. The bulb base 3 has a pair of opposed, radially extending latch pins 17. The barrel 14 usually forms a negative electrical contact for the bulb 2 or a common-negative contact when there are multiple filaments, such as a pair of filaments. On the end of the bulb base 3 opposite the envelope 15, an end contact 19 or a pair of end contacts 19 are positioned in diametric relation (FIG. 7) and insulated from the brass barrel 14. The end contact or contacts 19 are usually positive contacts for the bulb 2. The latch pins 17 are usually axially offset, as shown in FIGS. 3 and 5, to require that the bulb 2 be inserted into a socket structure in such a manner as to engage the end contacts 19 with the proper socket contacts, to thereby insure proper functioning of the lamp unit 4 as a signaling device. The bulb 2 may be any one of a number of standard bayonet bulb variations, such as ANSI (American National Standards Institute) 1003, 1004, 57, 1895, 67, 89, 1073, 1141, 1156, 1157, 2057, 2357, 1889, 1893, and the like.

The illustrated socket structure 1 includes a bulb support member 22 in the form of a sheet metal wall having a substantially circular socket opening 24 formed therein. The bulb support member 22 is formed of a conductive sheet metal having a resilient quality, as by stamping. The bulb support member 22 may include flanges 25 extending therefrom about portions of the opening 24 to stiffen the support member 22 in the area of the opening 24. The bulb support member 22 is mounted in the housing 10, as by fasteners 27, such as bolts, screws, or rivets. Alternatively, the bulb support member 22 could be secured by portions of the molded plastic housing 10. The illustrated housing 10 has a pair of resilient socket end contacts or connectors 29 mounted therein in spaced relation to the bulb support member 22. The socket end contacts 29 are illustrated as elongated strips of resilient sheet metal positioned in parallel relation and spaced apart for engagement by the two bulb end contacts 19 of the bulb 2 (see FIG. 11).

Referring to FIGS. 2-6, 8, and 9, a pair of pin retaining tabs 32 extend from the bulb support member 22 at the periphery of the socket opening 24 and in diametric opposition thereacross. The tabs 32 extend from the bulb support member 22 toward the socket end contacts 29. The tabs 32 include a short tab 33 and a long tab 34 to accommodate the axially offset upper latch pin 35 and lower latch pin 36 respectively. A free end of each tab 32 has a pin retaining notch 38 formed therein which opens toward the socket end contacts 29. The pin retaining notch 38 is formed by rounded cam surface 39 on one side and an abutment 40 on the opposite side. The cam surface 39 is continuous with a pin guide edge 41 of the tab 32 which also aligns with a clearance notch 42 formed in the bulb support member 22 at the socket opening 24. Each tab 32 includes a pin guide groove 44 which is aligned with the notch 38. The grooves 44 help to align the bayonet pins 17 with the notches 38 and also lessen the degree of outward flexing required of the tabs 32 by the pins 17 as the bulb 2 is inserted axially into the socket structure 1. The tabs 32 form an electrical connection with the conductive barrel 14 of the bulb 2 when the bulb is installed in the socket structure 1 by contact therewith.

Installation of the bulb 2 in the socket structure 1 during mechanical manufacture of the lamp unit 4 requires that the bayonet pins 35 and 36 be aligned with grooves 44 in the respective tabs 33 and 34 and that the bulb 2 be inserted along the cylindrical axis of the bulb base 3 by a mechanical bulb insertion member 5 into the socket opening 24 of the socket structure 1 until the pins 35 and 36 snap past the tabs 33 and 34 into the notches 38 at the ends thereof. Thereafter, if the bulb 2 needs to be replaced, it can be removed by twisting in a (usually) counterclockwise direction to disengage the pins 17 from the notches 38 by causing the pins 17 to ride onto the cam surfaces 39 of the tabs 32 and withdrawing the bulb 2 from the socket opening 24 with the pins 17 aligned with the clearance notches 42. Alternatively, the bulb 2 can be initially pushed in slightly against the resilient force of the socket end connectors 29 and twisted in a counterclockwise direction to disengage the pins 17 from the notches 38. A new bulb 2 can then be installed in the socket structure 1, either by strictly axial insertion as described above or in the conventional bayonet manner. For manual axial insertion of the bulb 2, the grooves 44 guide the pins 17 toward the notches 38. For bayonet insertion of the bulb 2, the pins 17 are aligned with the clearance notches 42 as the bulb 2 is moved axially toward engagement of the bulb end contacts 19 with the resilient socket end contacts 29. A slight twist in the clockwise direction maintains contact of the pins 17 with the guide edges 41 of the tabs 32. Continued axial insertion with a clockwise twist causes the pins 17 to ride along the cam surfaces 39 and into the notches 38, at which point the bulb 2 can be released. In both types of manual insertion of the bulb 2, inability to complete insertion of the bulb usually results from not having the upper and lower pins 35 and 36 properly aligned with the short and long tabs 32 and 33.

Although the socket structure 1 has been described and illustrated with the bulb support member 22 as a more or less flat resilient sheet metal structure, it is foreseen that a bulb support member could be formed of a tubular structure of plastic or other insulative material or of a metal. The pin retaining tabs could be integral with the bulb support member or separate members attached thereto. Therefore, it is to be understood that while certain forms of the present invention have been illustrated and described herein, it is not to be limited to the specific forms or arrangement of parts described and shown.

What is claimed and desired to be secured by Letters Patent is:

1. A light bulb socket for receiving a light bulb having a bayonet style bulb base including a cylindrical surface, an electrical end contact on a contact end of said bulb base, and a latch pin extending radially from said cylindrical surface, said socket comprising:

(a) a bulb support member including a socket opening sized and shaped to receive said bayonet style bulb base therein;

(b) a resilient socket end contact positioned in spaced relation to said bulb support member, engageable by said end contact of said bulb base, and resiliently urging said bulb base in a direction out of said bulb support member;

(c) said bulb support member including a resilient bayonet pin retainer tab including a pin notch opening toward said socket end contact, said pin notch formed at an edge of said tab closest to the socket end contact and a pin guiding groove formed on a radially inner side of said pin retainer tab in alignment with said pin notch, said pin guiding groove facilitating orientation of said latch pin with said pin notch upon insertion of said bulb base into said socket opening, said pin retainer cooperating with said bulb base to enable axial insertion of said bulb base into said socket opening with said latch pin aligned with said pin notch until said latch pin snaps past said pin retainer and into said pin notch; and d) said pin retainer enabling removal of said bulb base by rotation of said bulb base to disengage said latch pin from said pin notch and then axial withdrawal of said bulb base from said socket opening.

2. A socket as set forth in claim 1 and including:

(a) said bulb support member and said pin retainer being configured in such a manner as to enable alternative axial insertion of said bayonet bulb base into said socket opening and subsequent rotation thereof to latchingly engage said latch pin with said pin notch.

3. A socket as set forth in claim 1 wherein said bayonet bulb base has a pair of latch pins extending radially therefrom in a selected angular relation and including:

(a) said bulb support member including a pair of resilient bayonet pin retainers positioned in said selected angular relation, each pin retainer including a respective pin notch opening toward said socket end contact.

4. A socket as set forth in claim 3 wherein said latch pins are offset axially and wherein:

(a) said pin retainers are offset axially in a manner similar to said latch pins to enable engagement between each latch pin and a respective pin notch.

5. A socket as set forth in claim 1 wherein said cylindrical surface of said bulb base and said latch pin form an electrical contact of said bulb and wherein:

(a) said bayonet pin retainer forms a side electrical contact of said socket and cooperates with said socket end contact and external circuitry to cause illumination of said bulb.

6. A socket as set forth in claim 1 wherein:

(a) said bulb support member includes a sheet metal wall having said socket opening formed therethrough;

(b) said sheet metal wall is positioned in spaced relation to said socket end contact; and (c) said pin retainer is formed by a retainer pin tab extending from said sheet metal wall at said socket opening toward said socket end contact.

7. A light bulb socket for receiving a light bulb having a bayonet style bulb base including a cylindrical surface, an electrical end contact on a contact end of said bulb base, and a latch pin extending radially from said cylindrical surface, said socket comprising:

(a) a bulb support member including a socket opening sized and shaped to receive said bayonet style bulb base therein;

(b) a resilient socket end contact positioned in spaced relation to said bulb support member, engageable by said end contact of said bulb base, and resiliently urging said bulb base in a direction out of said bulb support member;

(c) said bulb support member including a resilient bayonet pin retainer including a pin notch opening toward said socket end contact, said pin retainer cooperating with said bulb base to enable axial insertion of said bulb base into said socket opening until said latch pin snaps past said pin retainer and into said pin notch;

(d) said pin retainer enabling removal of said bulb base by rotation of said bulb base to disengage said latch pin from said pin notch and then axial withdrawal of said bulb base from said socket opening;

(e) said pin retainer being a pin retainer tab extending toward said socket end contact and having said pin notch formed at an end of said tab closest to said socket end contact and a pin guiding groove formed on a radially inner side of said pin retainer tab in alignment with said pin notch, said pin guiding groove facilitating orientation of said latch pin with said pin notch upon insertion of said bulb base into said socket opening;

(f) said pin retainer tab including opposite side edges; and (g) said bulb support member including a pin clearance notch formed at said socket opening in alignment with one side edge of said tab, said clearance notch and said one side edge of said tab cooperating with said latch pin to enable said alternative axial insertion of said bulb base into said socket opening and subsequent rotation to latchingly engage said latch pin with said pin notch.

8. A light bulb socket for receiving a light bulb having a bayonet style bulb base including a latch pin extending radially from a cylindrical surface of said bulb base and an electrical end contact on a contact end of said bulb base, said socket comprising:

(a) a bulb support member including an opening sized and shaped to receive said bayonet style bulb base therein;

(b) a resilient socket end contact positioned in spaced relation to said bulb support member, engageable by said end contact of said bulb base, and resiliently urging said bulb base in a direction out of said bulb support member;

(c) said bulb support member including a resilient bayonet pin retainer tab including a pin notch opening toward said socket end contact, and said pin notch formed at an end of the tab and a pin guiding groove formed on a radially inner side of said pin retainer tab in alignment with said pin notch, said pin guiding groove facilitating orientation of said latch pin with said pin notch upon insertion of said bulb base into said socket opening; said tab enabling axial insertion of a bayonet bulb base into said socket opening with said latch pin aligned with said pin notch until said latch pin snaps past said tab and into said pin notch; and said tab enabling removal of said bulb base by initial axial movement of said bulb base against said socket end contact and rotation of said bulb base to disengage said latch pin from said pin notch and then axial withdrawal of said bulb base from said socket opening; and (d) said pin retainer tab cooperating with said bulb base to alternatively enable axial insertion of said bulb base into said socket opening and rotation of said bulb base to latchingly engage said latch pin with said pin notch.

9. A light bulb socket for receiving a light bulb having a bayonet style bulb base including a latch pin extending radially from a cylindrical surface of said bulb base and an electrical end contact on a contact end of said bulb base, said socket comprising:

(a) a bulb support member including an opening sized and shaped to receive said bayonet style bulb base therein;

(b) a resilient socket end contact positioned in spaced relation to said bulb support member, engageable by said end contact of said bulb base, and resiliently urging said bulb base in a direction out of said bulb support member;

(c) said bulb support member including a resilient bayonet pin retainer tab including a pin notch opening toward said socket end contact, said pin notch formed at an edge of said tab closest to the socket end contact and a pin guiding groove formed on a radially inner side of said pin retainer tab in alignment with said pin notch, said pin guiding groove facilitating orientation of said latch pin with said pin notch upon insertion of said bulb base into said socket opening, said tab enabling axial insertion of a bayonet bulb base into said socket opening until said latch pin snaps past said tab and into said pin notch; and said tab enabling removal of said bulb base by initial axial movement of said bulb base against said socket end contact and rotation of said bulb base to disengage said latch pin from said pin notch and then axial withdrawal of said bulb base from said socket opening; and (d) said pin retainer tab cooperating with said bulb base to alternatively enable axial insertion of said bulb base into said socket opening and rotation of said bulb base to latchingly engage said latch pin with said pin notch;

(e) said pin retainer tab including opposite side edges; and (f) said bulb support member including a pin clearance notch formed at said socket opening in alignment with one side edge of said tab, said clearance notch and said one side edge of said tab cooperating with said latch pin to enable said alternative axial insertion of said bulb base into said socket opening and subsequent rotation to latchingly engage said latch pin with said pin notch.

10. A socket as set forth in claim 9 wherein said bayonet bulb base has a pair of latch pins extending radially therefrom in a selected angular relation and including:

(a) said bulb support member including a pair of resilient bayonet pin retainer tabs positioned in said selected angular relation, each pin retainer including a respective pin notch opening toward said socket end contact.

11. A socket as set forth in claim 10 wherein said latch pins are offset axially and wherein:

(a) said pin retainer tabs have respective length to axially offset said pin notches in a manner similar to said latch pins to enable engagement between each latch pin and a respective pin notch.

12. A socket as set forth in claim 9 wherein said cylindrical surface of said bulb base and said latch pin form an electrical contact of said bulb and wherein:

(a) said bayonet pin retainer forms a side electrical contact of said socket and cooperates with said socket end contact and external circuitry to cause illumination of said bulb.

13. A socket as set forth in claim 9 wherein:

(a) said bulb support member includes a sheet metal wall having said socket opening formed therethrough;

(b) said sheet metal wall is positioned in spaced relation to said socket end contact; and (c) said pin retainer tab extends from said sheet metal wall at said socket opening toward said socket end contact.

14. A light bulb socket for receiving a light bulb having a bayonet style bulb base including a pair of latch pins extending radially from opposite sides of a cylindrical base and an electrical end contact on a contact end of said base, said socket comprising:

(a) a bulb support member including a socket opening sized and shaped to receive said bayonet style bulb base, said socket opening including a pair of opposite pin clearance notches;

(b) a resilient socket end contact positioned in spaced relation to said bulb support member, engageable by said electrical contact of said bulb base, and resiliently urging said bulb base in a direction out of said bulb support member;

(c) a pair of resilient pin retainer tabs positioned on said bulb support member on opposite sides of said opening and aligned respectively with said pin clearance notches, each of said tabs having a respective pin notch opening toward said socket end contact, said pin notch formed at an edge of said tab closest to the socket end contact and a pin guiding groove formed on a radially inner side of said pin retainer tab in alignment with said pin notch, said pin guiding groove facilitating orientation of said latch pin with said pin notches upon insertion of said bulb base into said socket opening the pin notches cooperating with aid latch pins to retain said bulb base within said bulb support member;

(d) said tabs cooperating with said bulb base to enable axial insertion of said bayonet style bulb base into said bulb support member with said latch pins aligned with said pin notches and snapping past said tabs and into said pin notches and said electrical contact engaging said socket end contact;

(e) said tabs and said pin clearance notches cooperating with said bulb base to enable alternative axial insertion of said bulb base into said socket opening with said latch pins aligned with said pin clearance notches and rotation of said bulb base to latchingly engage said latch pins respectively with said pin notches; and (f) said tabs cooperating with said bulb base to enable removal of said bulb base from said bulb support member by pushing said bulb in against resilience of said socket end contact and rotation of said bulb base to disengage said latch pins from said pin notches and align said latch pins with said pin clearance notches, followed by axial withdrawal of said bulb base from said socket opening.

15. A socket as set forth in claim 14 wherein said latch pins are offset axially and wherein:

(a) said pin retainer tabs have respective lengths to thereby axially offset said pin notches in a manner similar to said latch pins to enable engagement between each latch pin and a respective pin notch.

16. A socket as set forth in claim 14 wherein said cylindrical surface of said bulb base and said latch pins form an electrical contact of said bulb and wherein:

(a) said pin retainer tabs form a side electrical contact of said socket and cooperate with said socket end contact and external circuitry to cause illumination of said bulb.

17. A socket as set forth in claim 14 wherein:

(a) said bulb support member includes a sheet metal wall formed with said socket opening formed therethrough;

(b) said sheet metal wall is positioned in spaced relation to said socket end contact; and (c) said pin retainer tabs extend from said sheet metal wall at said socket opening toward said socket end contact.

* * * * *